US011999524B2

(12) United States Patent
Hong

(10) Patent No.: US 11,999,524 B2
(45) Date of Patent: Jun. 4, 2024

(54) ALUMINUM BOTTLE AND PREPARATION METHOD THEREOF

(71) Applicant: Hangzhou CPMC Co. LTD, Zhejiang (CN)

(72) Inventor: Xiaohui Hong, Zhejiang (CN)

(73) Assignee: Hangzhou CPMC Co. LTD, Zhejiang (CN)

( * ) Notice: Subject to any disclaimer, the term of this patent is extended or adjusted under 35 U.S.C. 154(b) by 219 days.

(21) Appl. No.: 17/564,552

(22) Filed: Dec. 29, 2021

(65) Prior Publication Data

US 2022/0212829 A1 Jul. 7, 2022

(30) Foreign Application Priority Data

Jan. 4, 2021 (CN) ..... 202110002684.9

(51) Int. Cl.
*B65D 1/02* (2006.01)
*B21D 51/24* (2006.01)
*B65D 23/08* (2006.01)

(52) U.S. Cl.
CPC ..... *B65D 1/0215* (2013.01); *B21D 51/24* (2013.01); *B65D 23/0828* (2013.01)

(58) Field of Classification Search
CPC .. B65D 1/0215; B65D 23/0828; B21D 51/24; B21D 51/26; C22C 21/00; C22C 1/026; B05D 7/14; C09D 127/18; C22F 1/04
See application file for complete search history.

(56) References Cited

U.S. PATENT DOCUMENTS 4,789,566 A * 12/1988 Tatsuno ..... B05D 7/56 427/407.1
2005/0284551 A1* 12/2005 Saeki ..... C22F 1/04 148/692
2012/0055285 A1* 3/2012 Mercuri ..... B22F 9/305 422/198
2012/0073628 A1* 3/2012 Yoshida ..... H02S 40/20 136/246
2016/0265095 A1* 9/2016 Handa ..... C22F 1/00
2018/0133776 A1* 5/2018 Pilon ..... B21D 26/049

* cited by examiner

*Primary Examiner* — Lawrence Averick
(74) *Attorney, Agent, or Firm* — INNOVAR, L.L.C.; Rick Matos

(57) ABSTRACT

The present disclosure provides an aluminum bottle and a preparation method thereof and belongs to the technical field of alloy. The present disclosure can improve the structure and enhance impact mechanical properties of an aluminum material by controlling a content of manganese to be 0.03-0.5 wt. %. Nickel can improve the strength and rust resistance of the aluminum material. Strontium can form an aluminum-strontium combination to adjust the crystal orientation of a metal lattice, improve forming, and greatly enhance the flexibility. Zirconium acts synergistically to improve the corrosion resistance of the aluminum material and improve surface gloss. The prepared aluminum material is light in weight and has the advantage of high bearing strength.

7 Claims, 2 Drawing Sheets

ALUMINUM BOTTLE AND PREPARATION METHOD THEREOF

CROSS REFERENCE TO EARLIER-FILED APPLICATION

This patent application claims the benefit and priority of Chinese Patent Application No. 202110002684.9, filed on Jan. 4, 2021, the disclosure of which is hereby incorporated by reference herein in its entirety as part of the present application.

TECHNICAL FIELD

The present disclosure relates to the technical field of alloy, and in particular to an aluminum bottle and a preparation method thereof.

BACKGROUND ART

The aluminum bottle is cold extruded and deep drawn with pure aluminum as a basic material. It is made of soft aluminum, which has excellent processing flexibility and high applicability for processing and forming. As a new star in the field of metal packaging, aluminum bottles have emerged in the food and beverage packaging market in recent years, and are increasingly widely used. There is no lack of product applications of well-known brand customers such as beer packaging and soft drink packaging.

Based on a 12 floz aluminum bottle, the bottle weight of the current aluminum bottle process reaches 45 g. With the intensification of environmental resources and cost control, the need for lightweight aluminum bottles needs to be solved urgently. The complexity of the lightweight process of the aluminum bottles presents huge instability and difficulty as the pipe diameter becomes larger.

SUMMARY OF THE INVENTION

In view of the above, an objective of the present disclosure is to provide an aluminum bottle and a preparation method thereof. The aluminum bottle provided by the present disclosure is light in weight, realizing the lightweight of aluminum bottles.

To achieve the above objective, the present disclosure provides the following technical solutions.

The present disclosure provides an aluminum bottle, including an inner coating layer, an aluminum plate base layer, a surface passivation layer, an amino primer layer, a printing pigment layer, a surface paint protection layer, and a wear-resistant layer sequentially stacked. The aluminum plate base layer includes the following elements by mass percentage: 0.1-0.2% of Si, 0.25-0.35% of Fe, 0-0.05% of Cu, 0.03-0.5% of Mn, 0-0.03% of Mg, 0-0.05% of Zn, 0-0.05% of Ti, 0-0.03% of Ni, 0-0.05% of Sr, 0-0.05% of Zr, 0-0.05% of B, and the balance of Al. The Al has a mass percentage ≥99.2%. The Cu, the Mg, the Zn, the Ti, the Ni, the Sr, the Zr, and the B have mass percentages not being 0.

Preferably, the inner coating layer may be made of epoxy coatings or polyester coatings.

Preferably, the wear-resistant layer may be a polytetrafluoroethylene (PTFE) layer.

The present disclosure further provides a preparation method of the aluminum bottle according to the above technical solution, including the following steps:

performing batching according to the elements of the aluminum plate base layer, and then smelting to obtain molten aluminum;

performing primary slagging, refinement, secondary slagging, refined degassing, and casting rolling sequentially on the molten aluminum to obtain an aluminum coil billet;

performing primary hot casting rolling, cooling, secondary cold rolling, and punching sequentially on the aluminum coil billet to obtain an aluminum block billet;

performing annealing and first aging treatment sequentially on the aluminum block billet to obtain a first aging product;

performing surface treatment and second aging treatment on the first aging product to obtain an aluminum material;

stamping and forming the aluminum material to obtain a bowl-shaped aluminum block;

performing arrangement, extrusion, and surface treatment sequentially on the bowl-shaped aluminum block to obtain a can body forming the surface passivation layer;

spraying on an inner surface of the can body forming the surface passivation layer to form the inner coating layer;

forming the amino primer layer, the printing pigment layer, the surface paint protection layer, and the wear-resistant layer sequentially on an outer surface of the can body forming the surface passivation layer to obtain a treated can body; and necking the treated can body to obtain the aluminum bottle.

Preferably, a process of forming the amino primer layer may include the following steps: coating amino coatings, and then drying at 100-200° C. for 5-15 min.

Preferably, a process of forming the surface paint protection layer may include the following steps: coating surface paint protection coatings including an improved polyester material and PTFE, and then drying at 100-200° C. for 5-15 min.

Preferably, the PTFE in the surface paint protection coatings may have a mass content of 0.2-0.4%.

Preferably, a process of forming the wear-resistant layer may include the following steps: performing heating curing and aging treatment sequentially on the surface paint protection layer to form the wear-resistant layer on a surface of the surface paint protection layer.

Preferably, the surface passivation layer may be prepared by cleaning with a cleaning solution, and the cleaning solution may include sodium salt, potassium salt, zirconium salt, and a surfactant.

Preferably, the necking may be performed for 40 times at a necking amount of 1-5 mm in each step.

The present disclosure provides an aluminum bottle, including an inner coating layer, an aluminum plate base layer, a surface passivation layer, an amino primer layer, a printing pigment layer, a surface paint protection layer, and a wear-resistant layer sequentially stacked. The aluminum plate base layer includes the following elements by mass percentage: 0.1-0.2% of Si, 0.25-0.35% of Fe, 0-0.05% of Cu, 0.03-0.5% of Mn, 0-0.03% of Mg, 0-0.05% of Zn, 0-0.05% of Ti, 0-0.03% of Ni, 0-0.05% of Sr, 0-0.05% of Zr, 0-0.05% of B, and the balance of Al. The Al has a mass percentage ≥99.2%. The Cu, the Mg, the Zn, the Ti, the Ni, the Sr, the Zr, and the B have mass percentages not being 0. The present disclosure can improve the structure and enhance impact mechanical properties of an aluminum material by controlling a content of manganese to be 0.03-0.5 wt. %. Nickel can improve the strength and rust resistance of the aluminum material. Strontium can form an aluminum-strontium combination to adjust the crystal orientation of a metal lattice, improve forming, and greatly enhance the flexibility. Zirconium acts synergistically to improve the corrosion resistance of the aluminum material, and improve surface gloss. The prepared aluminum material is light in weight, and has the advantage of high bearing strength. The present disclosure can improve the wear resistance and corrosion resistance of the aluminum bottle through the surface passivation layer, the amino primer layer, the printing pigment layer, the surface paint protection layer, and the wear-resistant layer. The aluminum material provided by the present disclosure has a hardness of 23-30 HB, a tensile strength of 70-100 MPa, a yield strength of 35-59 MPa, and a breaking elongation of 40-60%. The aluminum material has no oil stains, dust, pores, and slag inclusions, and there are no pull marks on the surface, no surface tearing, no sharp burrs and pits over 0.2 mm, and no obvious texture direction on the surface. The present disclosure takes a 12 floz aluminum bottle as an example. The bottle weight of the aluminum bottle process reaches 32 g, and the weight of the aluminum bottle is reduced by 10-30% under the same bearing strength. At the same time, the lightweight of an aluminum can with a diameter D of 40 mm or more is realized. It has advantages in energy saving and consumption reduction.

The present disclosure further provides the preparation method of the aluminum bottle according to the above technical solution, including the following steps: performing batching according to the elements of the aluminum plate base layer, and then smelting to obtain molten aluminum; performing primary slagging, refinement, secondary slagging, refined degassing, and casting rolling sequentially on the molten aluminum to obtain an aluminum coil billet; performing primary hot casting rolling, cooling, secondary cold rolling, and punching sequentially on the aluminum coil billet to obtain an aluminum block billet; performing annealing and first aging treatment sequentially on the aluminum block billet to obtain a first aging product; performing surface treatment and second aging treatment on the first aging product to obtain an aluminum material; stamping and forming the aluminum material to obtain a bowl-shaped aluminum block; performing arrangement, extrusion, and surface treatment sequentially on the bowl-shaped aluminum block to obtain a can body forming the surface passivation layer; spraying on an inner surface of the can body forming the surface passivation layer to form the inner coating layer; forming the amino primer layer, the printing pigment layer, the surface paint protection layer, and the wear-resistant layer sequentially on an outer surface of the can body forming the surface passivation layer to obtain a treated can body; and necking the treated can body to obtain the aluminum bottle. In the present disclosure, the primary slagging can remove most of the impurities (large particles of foreign matters contained in the aluminum alloy, mainly non-metallic and iron-based non-melt matters) and oxides. The refinement can refine crystal grains. The secondary slagging can completely remove the impurities (small particles and high melting point wastes generated during the melting of aluminum alloy) and the oxides. The refined degassing can improve the quality of a melt, so as to facilitate the production of qualified cast-rolled materials. The annealing and the first aging treatment can disperse the stress, make the anisotropic stress uniform, and provide good metal material fluidity for subsequent aluminum block forming. The surface treatment and the second aging treatment can reduce the difference in the internal structure of the aluminum material at different times.

DETAILED DESCRIPTION OF THE INVENTION

The present disclosure provides an aluminum bottle, including an inner coating layer, an aluminum plate base layer, a surface passivation layer, an amino primer layer, a printing pigment layer, a surface paint protection layer, and a wear-resistant layer sequentially stacked. The aluminum plate base layer includes the following elements by mass percentage: 0.1-0.2% of Si, 0.25-0.35% of Fe, 0-0.05% of Cu, 0.03-0.5% of Mn, 0-0.03% of Mg, 0-0.05% of Zn, 0-0.05% of Ti, 0-0.03% of Ni, 0-0.05% of Sr, 0-0.05% of Zr, 0-0.05% of B, and the balance of Al. The Al has a mass percentage ≥99.2%. The Cu, the Mg, the Zn, the Ti, the Ni, the Sr, the Zr, and the B have mass percentages not being 0.

Figure 2:
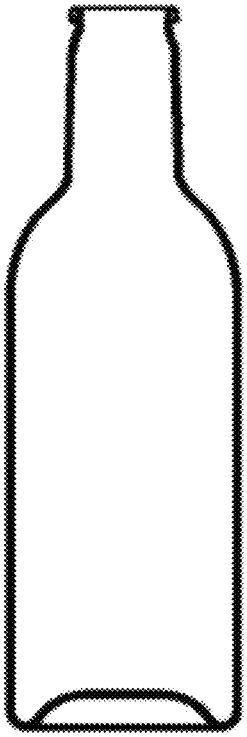
FIG. 2 is a schematic diagram of an overall structure of an aluminum bottle of the present disclosure.
Figure 3:
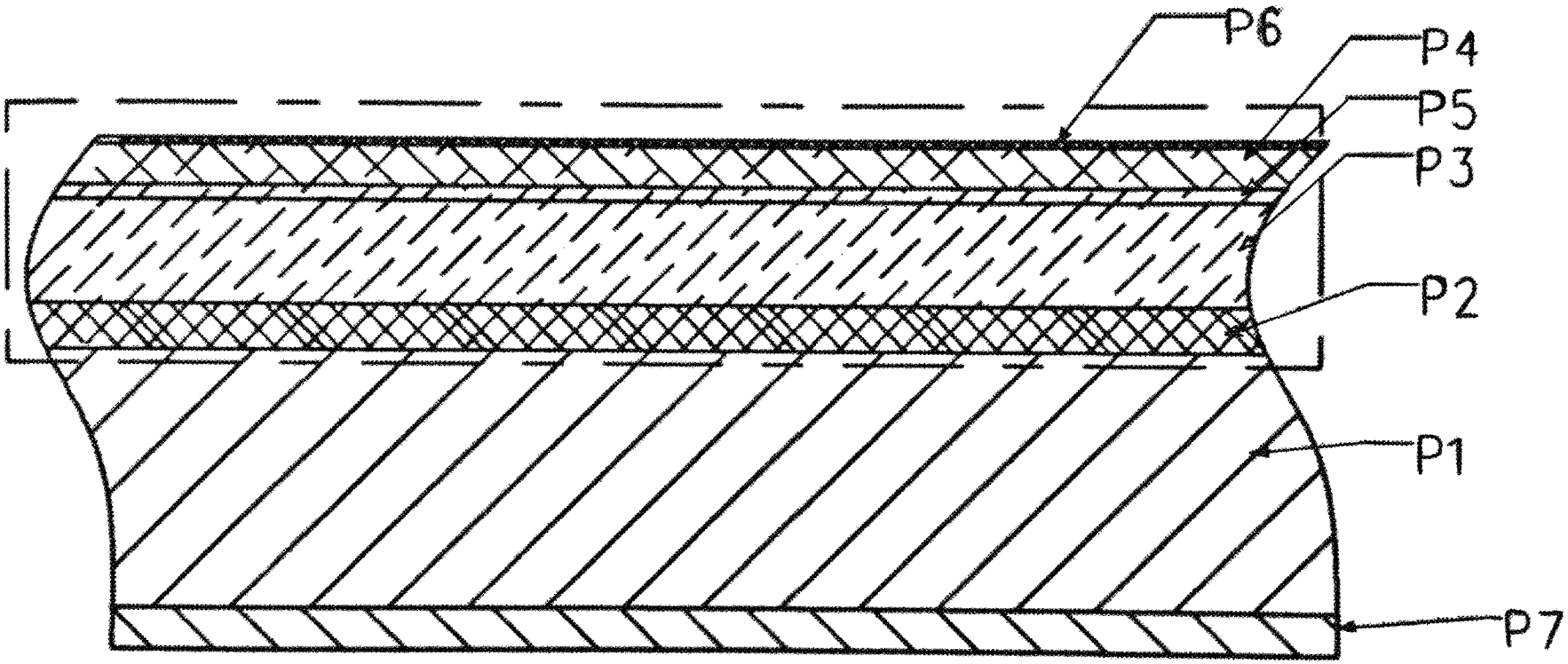
FIG. 3 is a schematic diagram of a layered structure of the aluminum bottle of the present disclosure, where P1 is an aluminum plate base layer, P2 is a surface passivation layer, P3 is an amino primer layer, P5 is a printing pigment layer, P4 is a surface paint protection layer, P6 is a wear-resistant layer, and P7 is an inner coating layer.

FIG. 2 is a schematic diagram of an overall structure of the aluminum bottle of the present disclosure. FIG. 3 is a schematic diagram of a layered structure of the aluminum bottle of the present disclosure. P1 is the aluminum plate base layer, P2 is the surface passivation layer, P3 is the amino primer layer, P5 is the printing pigment layer, P4 is the surface paint protection layer, P6 is the wear-resistant layer, and P7 is the inner coating layer.

By mass percentage, the aluminum plate base layer of the present disclosure preferably includes 0.15-0.18 wt. % of Si. The Si can enhance the strength of the aluminum bottle.

By mass percentage, the aluminum plate base layer of the present disclosure preferably includes 0.28-0.32 wt. % of Fe. The Fe can enhance the strength of the aluminum bottle.

By mass percentage, the aluminum plate base layer of the present disclosure preferably includes 0.01-0.03 wt. % of Cu. The Cu can enhance the strength of the aluminum bottle.

By mass percentage, the aluminum plate base layer of the present disclosure preferably includes 0.1-0.3 wt. % of Mn. The Mn can improve the structure and enhance impact mechanical properties of the aluminum bottle.

By mass percentage, the aluminum plate base layer of the present disclosure preferably includes 0.01-0.02 wt. % of Mg. The Mg can enhance the rust resistance of the aluminum bottle and improve the surface processing fluidity.

By mass percentage, the aluminum plate base layer of the present disclosure preferably includes 0.01-0.03 wt. % of Zn. The Zn can adjust a crystal grain structure and promote the optimization of the aluminum bottle.

By mass percentage, the aluminum plate base layer of the present disclosure preferably includes 0.01-0.03 wt. % of Ti. The Ti can be used as a regulator to adjust the internal crystal phase structure of the aluminum bottle and refine crystal grains.

By mass percentage, the aluminum plate base layer of the present disclosure preferably includes 0.01-0.02 wt. % of Ni. The nickel can improve the strength and rust resistance of the aluminum bottle.

By mass percentage, the aluminum plate base layer of the present disclosure preferably includes 0.01-0.03 wt. % of Sr. The strontium can form an aluminum-strontium combination to adjust the crystal orientation of a metal lattice, improve forming, and greatly enhance the flexibility.

By mass percentage, the aluminum plate base layer of the present disclosure preferably includes 0.01-0.03 wt. % of Zr. The zirconium and the strontium act synergistically to improve the corrosion resistance of the aluminum bottle, and improve surface gloss.

In the present disclosure, the aluminum plate base layer has a hardness of preferably 23-30 HB, a tensile strength of preferably 70-100 MPa, a yield strength of preferably 35-59 MPa, and a breaking elongation of preferably 40-60%.

In the present disclosure, the aluminum plate base layer has a thickness of preferably 0.2-0.6 mm.

In the present disclosure, the inner coating layer is preferably made from high molecular weight polyester, and the inner coating layer has a thickness of preferably 5-30 μm.

In the present disclosure, the surface passivation layer is preferably made of epoxy coatings or polyester coatings, and the surface passivation layer has a thickness of preferably 1-5 μm.

In the present disclosure, the amino primer layer is preferably obtained by spraying an amino primer, and the amino primer layer has a thickness of preferably 5-30 μm. In the present disclosure, the amino primer has a viscosity of preferably 70-120 s (25° C.).

In the present disclosure, the printing pigment layer has a thickness of preferably 2-10 ρ m.

In the present disclosure, the surface paint protection layer is preferably obtained by coating surface paint protection coatings. The surface paint protection coatings preferably include an improved polyester material and PTFE. In the present disclosure, the PTFE in the surface paint protection coatings has a mass content of preferably 0.2-0.4%.

In the present disclosure, the surface paint protection layer has a thickness of preferably 5-30 μm.

In the present disclosure, the wear-resistant layer is preferably a PTFE layer. The wear-resistant layer has a thickness of preferably 1-5 μm. In the PTFE layer, PTFE particles have a diameter of preferably 0.2-2 μm.

In the present disclosure, a process of forming the wear-resistant layer includes the following steps: performing heating curing on the surface paint protection layer to form the wear-resistant layer on a surface of the surface paint protection layer.

The present disclosure further provides a preparation method of the aluminum bottle according to the above technical solution, including the following steps.

Batching is performed according to the elements of the aluminum plate base layer, and then smelting is performed to obtain molten aluminum.

Primary slagging, refinement, secondary slagging, refined degassing, and casting rolling are performed sequentially on the molten aluminum to obtain an aluminum coil billet.

Primary hot casting rolling, cooling, secondary cold rolling, and punching are performed sequentially on the aluminum coil billet to obtain an aluminum block billet.

Annealing and first aging treatment are performed sequentially on the aluminum block billet to obtain a first aging product.

Surface treatment and second aging treatment are performed on the first aging product to obtain an aluminum material.

The aluminum material is stamped and formed to obtain a bowl-shaped aluminum block.

Arrangement, extrusion, and surface treatment are performed sequentially on the bowl-shaped aluminum block to obtain a can body forming the surface passivation layer.

Spraying is performed on an inner surface of the can body forming the surface passivation layer to form the inner coating layer.

The amino primer layer, the printing pigment layer, the surface paint protection layer, and the wear-resistant layer are formed sequentially on an outer surface of the can body forming the surface passivation layer to obtain a treated can body.

The treated can body is necked to obtain the aluminum bottle.

In the present disclosure, unless otherwise specified, all raw materials used are commercially available products conventional in the art.

In the present disclosure, batching is performed according to the elements of the aluminum plate base layer, and then smelting is performed to obtain molten aluminum.

In the present disclosure, the batching process preferably uses 1090 standard aluminum ingots and 3003 recycled aluminum bottles for mixing configuration, homogenizes the slitting and mixing treatment, then hoists a blast furnace in units of 3-10 T, performs disperse treatment, starts a smelting furnace for smelting at 600-900° C., keeps a molten state for 0.5-1 h, then disturbs and stirs with a high-pressure gas column at a rotary speed of 2-20 rpm for 15-45 min, and then adds an Fe agent, an Si agent, a Cu agent, an Mn agent, an Mg agent, a Zn agent, a Ti agent, an Ni agent, a Zr agent, and an Sr agent. In the present disclosure, a gas of the high-pressure gas column is preferably an inert gas, and the pressure is preferably 2-8 bar. The use of 3003 recycled aluminum bottles in the present disclosure can realize resource reuse, improve environmental performance, and reduce costs. In the present disclosure, the amount of the 3003 recycled aluminum bottles preferably accounts for 10 wt. % of the feed.

After the molten aluminum is obtained, the present disclosure performs primary slagging, refinement, secondary slagging, refined degassing, and casting rolling sequentially on the molten aluminum to obtain an aluminum coil billet.

In the present disclosure, the primary slagging preferably uses an air column for stirring of the molten aluminum.

In the present disclosure, after the primary slagging is completed, the present disclosure preferably further includes sampling analysis and secondary adjustment. The secondary adjustment can add an alloying agent to adjust the content of each element in the alloy to be consistent with the above solution.

In the present disclosure, the secondary slagging preferably uses a TI-B refiner. The TI-B refiner preferably includes TiB particles and a rare earth refiner. The amount of the TI-B refiner preferably accounts for 0.08 wt. % of the molten aluminum. 0.05-0.07 wt. % of the TI-B refiner is used. 0.01-0.03 wt. % of the rare earth refiner is used. The present disclosure uses the TiB particles and the rare earth refiner together as a grain refiner, and does not affect grain refinement and does not conflict with other alloying elements by first refining and stabilizing, and then adding alloy-strengthening alloy.

In the present disclosure, the TI-B refiner is preferably kept at a constant temperature of 0.5-1 h after being added.

In the present disclosure, a process of the refined degassing process preferably includes performing on-line purification, degassing, and slag removal in a degassing device to remove stress and improve the quality of a melt, so as to facilitate the production of qualified cast-rolled materials.

In the present disclosure, after the refined degassing, the present disclosure preferably further includes performing impurity removal and filtration using a secondary filtering device.

In the present disclosure, the casting rolling is preferably performed on a rotary belt casting machine, and aluminum liquid after the impurity removal and filtration is cast and rolled into an aluminum coil billet by a continuous rotating casting roller. The present disclosure has no special limitation on the rotary belt casting machine, and a rotary belt casting machine composed of a casting wheel and a steel belt, which is well known in the prior art, may be used.

After the aluminum coil billet is obtained, the present disclosure performs primary hot casting rolling, cooling, secondary cold rolling, and punching sequentially on the aluminum coil billet to obtain an aluminum block billet.

In the present disclosure, after the primary hot casting rolling, the thickness is preferably reduced by 30-80%, and after the secondary cold rolling, the thickness is preferably reduced by 20-60%. In embodiments of the present disclosure, the thickness is preferably reduced by an amount of 3-15 mm each time.

In the present disclosure, the cooling is preferably performed sequentially at 500° C. for 0.5-2 h and 300° C. for 0.5-2 h.

In the present disclosure, a cold-rolled material obtained by the secondary cold rolling has a width of preferably 0.3-1.5 m.

In the present disclosure, the punching preferably uses a punching machine with a tonnage of 100 tons or more to punch out an aluminum block.

In the present disclosure, oil is preferred to protect a punching surface of the aluminum block in the punching process, and the oil is preferably MOBILSHCCIBUS68 lubricating oil, which is sprayed with 5-10 g/50-100 workpieces each time. In the present disclosure, the cold-rolled material directly enters a subsequent punching process, which has the advantage of no slitting process, high efficiency and low consumption.

After the aluminum block billet is obtained, the present disclosure performs annealing and first aging treatment sequentially on the aluminum block billet to obtain a first aging product.

In the present disclosure, the annealing and first aging treatment are performed independently preferably at 300-500° C., and more preferably, 400-500° C., preferably for 2-20 h, and more preferably, 10-15 h.

After the first aging treatment is completed, the present disclosure preferably cools naturally and stores the first aging treatment product for 2-8 h.

In the present disclosure, it is preferable to continuously keep a top space of a smelting furnace filled with an inert gas in the annealing process to prevent excessive oxidation. In the annealing process, the aluminum block is softened, and the remaining oil in the punching process is removed.

After the first aging product is obtained, the present disclosure performs surface treatment and second aging treatment on the first aging product to obtain an aluminum material.

In the present disclosure, the surface treatment is preferably an aluminum alloy surface granulation treatment process, and more preferably, the material obtained after the first aging treatment is preferably passed through a densely-sprayed tunnel to obtain a dense annular gravure aluminum block with a uniform corrugated surface. Aluminum alloy particles with high surface strength are sprayed in the tunnel, and the aluminum alloy particles have a particle size of preferably 0.3-1 mm. In the present disclosure, the aluminum alloy particles with high surface strength are preferably 3003 aluminum alloy particles with a hardness of 24-30 HB.

In the present disclosure, the dense annular gravure aluminum block is easy to be subjected to surface lubrication treatment, and the surface quality of the subsequent stretch forming is better.

In the present disclosure, the dense spray is performed at an air pressure of preferably 2-10 bar and a density of preferably 10-20 lattices/$mm^2$.

In the present disclosure, the second aging treatment is performed at a temperature of preferably 80-200° C. for preferably 0.5-2 h.

In the present disclosure, the second aging treatment can reduce the difference in the structure of the aluminum bottle.

After a second aging product is obtained, the present disclosure preferably mixes the obtained second aging product, polyol, and a fatty acid surface treatment agent, and then performs surface additive treatment to obtain a transition layer, and then removes the transition layer to obtain the aluminum bottle. In the present disclosure, the transition layer can increase the surface lubrication effect of the aluminum bottle, and the surface lubrication effect during subsequent use can improve the forming processing efficiency.

In the present disclosure, the polyol is preferably ethanol or ethylene glycol, and the fatty acid surface treatment agent is preferably sodium stearate, stearamide, or N,N'-ethylen-ebis(stearamide).

In the present disclosure, the second aging product, the polyol, and the fatty acid surface treatment agent have a mass ratio of preferably (300-400):(0.3-1.0):(0.03-0.5).

In the present disclosure, the surface additive treatment is preferably performed under the condition of surface rolling, the surface rolling is performed at a rotary speed of preferably 10-80 rpm for preferably 10-30 min. The surface additive treatment can promote the emergence of the transition layer on the surface of the aluminum bottle, which plays the role of lubricating the surface of the aluminum bottle during subsequent processing so as to improve the forming processing efficiency.

After the aluminum material is obtained, the present disclosure stamps and forms the aluminum material to obtain a bowl-shaped aluminum block.

In the present disclosure, the bowl-shaped aluminum block has an outer diameter of preferably 34-80 mm, a depth of preferably 0.5-2 mm, a diameter of an inner concave surface of preferably 10-66 mm, and an angle of the inner concave surface to a horizontal plane of preferably 1-12°. In the present disclosure, corners of the bowl-shaped aluminum block are right-angled, have relatively less sharp corner wear, less aluminum shatter, can keep a die clean for a long time, have an arched structure, and have good lubrication, which is conducive to the flow of the aluminum material during extrusion and stretch forming, and the appearance of a formed part is good.

The present disclosure has no special limitation on specific operation of the stamping and forming, and a method well known to those skilled in the art may be used.

After the bowl-shaped aluminum block is obtained, the present disclosure performs arrangement, extrusion, and surface treatment sequentially on the bowl-shaped aluminum block to obtain a can body forming the surface passivation layer.

The present disclosure preferably arranges the bowl-shaped aluminum block in a consistent concave surface, and more preferably, arranges the bowl-shaped aluminum block in a consistent manner by a concave surface selector. In the present disclosure, the concave surface selector works at a speed of preferably 200-500 pc/min.

In the present disclosure, the extrusion preferably includes extruding the bowl-shaped aluminum block into a barrel shape using an integrated extruder through a stable and strong extrusion force, and the obtained barrel-shaped structure is uniform and smooth at a processing deformation position, without wrinkles, scratches, and cracks. In the present disclosure, a minimum extrusion height is preferably 130-240 mm. The can bottom of the barrel-shaped structure has a thickness of preferably 0.35-0.65 mm, and the wall of the barrel-shaped structure has a thickness of preferably 0.2-0.35 mm.

After the extrusion is completed, the present disclosure preferably further includes trimming a barrel-shaped aluminum can body according to a designed can body length, and the mouth of the trimmed aluminum barrel preferably has no wrinkles and notches.

In the present disclosure, the surface treatment preferably includes first surface treatment and second surface treatment performed sequentially. The first surface treatment preferably includes the following steps: brushing and grinding an outer surface of the barrel-shaped aluminum can body with reticulated stripes, and removing uneven protrusions and irregular stripes on the surface of the extruded aluminum material, such that the surface becomes flat and smooth for printing and further forming. The second surface treatment preferably includes the following steps: cleaning a first surface treatment product with a cleaning solution, and then drying. In the present disclosure, the cleaning solution preferably includes sodium salt, potassium salt, zirconium salt, and a surfactant. The cleaning is performed at a temperature of preferably 50-100° C., and more preferably 60-70° C., for preferably 1-5 min. The cleaning can form the surface passivation layer P2 on the surface of the aluminum plate base layer to further improve the printing and processing performance. The present disclosure has no special limitation on specific parameters of the drying, as long as the cleaning solution can be completely removed. In the present disclosure, the sodium salt, the potassium salt, the zirconium salt, and the surfactant have a mass ratio of 3:3:2:3.

After the can body forming the surface passivation layer is obtained, the present disclosure sprays on an inner surface of the can body forming the surface passivation layer to form the inner coating layer.

In the present disclosure, coatings for forming the inner coating layer are preferably epoxy-polyester resin coatings, the spraying is performed for preferably 1-3 times, and a coating film layer of the can wall is uniform from the bottom to the body. The inner coating layer can make the aluminum bottle have a good anti-corrosion effect of the content.

After the spraying is completed, the present disclosure preferably performs drying and curing in a drying oven. The present disclosure has no special limitation on specific parameters of the drying and curing, which can make the coating film adhesion test of the inner coating layer reach level I, and the density test of the inner coating layer ≤5 mA.

After the can body forming the surface passivation layer is obtained, the present disclosure forms the surface passivation layer, the amino primer layer, the printing pigment layer, the surface paint protection layer, and the wear-resistant layer sequentially on an outer surface forming the surface passivation layer to obtain a treated can body.

In the present disclosure, the amino primer layer is preferably obtained by coating amino primer, and the amino primer has a viscosity of preferably 70-120 s (25° C.).

In the present disclosure, after the coating is completed, the present disclosure preferably further includes drying at a temperature of preferably 100-200° C. for preferably 5-15 min.

In the present disclosure, the formation of the printing pigment layer is preferably simultaneous printing using a multi-color printer. The overprint accuracy of the simultaneous printing of the multi-color printer is preferably 0.02 mm. After the formation of the printed pigment layer, the present disclosure preferably further includes drying at a temperature of preferably 100-200° C. for preferably 5-15 min.

After the printing pigment layer is formed, the present disclosure preferably further includes a step of coating varnish on the printing pigment layer. The varnish can ensure that a necking deformation process will not damage the printing pigment layer and enhance the visual gloss effect. In the present disclosure, the varnish has a viscosity of preferably 70-120 s (25° C.). After the coating is completed, the present disclosure preferably further includes drying at a temperature of preferably 100-200° C. for preferably 5-15 min.

In the present disclosure, the surface paint protection layer is preferably obtained by coating surface paint protection coatings. The surface paint protection coatings preferably include an improved polyester material and PTFE.

In the present disclosure, the PTFE in the surface paint protection coatings has a mass content of preferably 0.2-0.4%.

In the present disclosure, a process of forming the wear-resistant layer preferably includes the following steps: performing heating curing and aging treatment sequentially on the surface paint protection layer to form the wear-resistant layer on a surface of the surface paint protection layer.

In the present disclosure, the heating curing is performed at a temperature of preferably 150-200° C. for preferably 5-15 min. After the curing, the aging treatment is performed at a temperature of preferably 50° C. for preferably 1-2 h.

After the treated can body is obtained, the present disclosure necks the treated can body to obtain the aluminum bottle.

In the present disclosure, the necking is preferably performed for 40 times at a necking amount of 1-5 mm in each step.

In the present disclosure, the necking preferably uses a rolling and pressing integrated construction process, and a formed can with a necking and rolling mouth shape is preferably formed on the can body according to different forming angles through the necking, so as to ensure that the necked can body is uniform and smooth at the processing deformation position, without wrinkles, scratches, cracks, and pits.

In the present disclosure, the weight deviation of each batch of cans for the necking is preferably ±2 g. A bottle mouth has an outer diameter after necking forming of preferably 26.6±0.2 mm, and the bottle mouth has an inner diameter of preferably 20.5±0.2 mm. The crimping has a height of preferably 3.85±0.2 mm. The can height deviation is preferably H ±0.5 mm, where H is the can height.

After the necking is completed, the present disclosure preferably further includes leak detection, and the leak detection is preferably performed automatically after air pressure filling, so that micropores with a size of 0.1 mm is found in a strong light detector.

After the leak detection is completed, the present disclosure preferably further includes drying. The drying preferably includes washing the obtained aluminum can with pure water in a post-washing machine, and drying at a high temperature in a 100,000-level purification workshop.

After the drying is completed, the present disclosure preferably completes the inner packaging and then transfers the entire tray to the outside of a clean room for replacement of the outer tray packaging, uses a wrapping film to package and fix the outside of the entire aluminum can tray, and makes a mark to obtain the aluminum bottle.

After the aluminum bottle is obtained, the present disclosure preferably further includes finished product inspection, and more preferably strict inspection according to product standard requirements. The inspection preferably includes adhesion detection of a finished paint film, hardness detection of an outer coating layer, density detection of the inner coating layer, pressure resistance detection, chemical stability testing of the inner and outer coating layers, and microbiological detection.

To further describe the present disclosure, the aluminum bottle and the preparation method thereof provided by the present disclosure are described in detail below with reference to examples. However, these examples should not be construed as limitations to the protection scope of the present disclosure.

Example 1

An aluminum bottle of the present disclosure includes an inner coating layer (5 μm), an aluminum plate base layer (0.2 mm), a surface passivation layer (5 μm), an amino primer layer (5 μm), a printing pigment layer (2 μm), a surface paint protection layer (5 μm), and a wear-resistant layer (5 μm) sequentially stacked.

The aluminum plate base layer of the aluminum bottle of this example includes the following elements by mass percentage: 0.1% of Si, 0.25% of Fe, 0.01% of Cu, 0.3% of Mn, 0.03% of Mg, 0.02% of Zn, 0.02% of Ti, 0.03% of Ni, 0.01% of Sr, 0.01% of Zr, 0.01% of B, and the balance of Al.

The preparation method includes the following steps.

Batching: the batching process preferably uses 1090 standard aluminum ingots and 10 wt. % of 3003 recycled aluminum bottles for mixing configuration, homogenizes the slitting and mixing treatment, then hoists a blast furnace in units of 3 T, performs disperse treatment, starts a smelting furnace for smelting at 600° C., keeps a molten state for 0.5 h, and then disturbs and stirs with a high-pressure gas column for 15 min to obtain molten aluminum. The gas column is an inert gas. After an Fe agent, an Si agent, a Cu agent, an Mn agent, an Mg agent, a Zn agent, a Ti agent, an Ni agent, a Zr agent, and an Sr agent are added, primary slagging is performed (air column stirring). Then sampling analysis and secondary adjustment are performed. Then a mixture is added into a refining furnace for grain refinement, and stirred with an air column. A special TI-B refiner is added for refinement (the TI-B refiner includes TiB particles and a rare earth refiner. The amount of the TI-B refiner preferably accounts for 0.08 wt. % of the molten aluminum. The TI-B refiner includes 0.05 wt. % of the TiB particles, and 0.03 wt. % of the rare earth refiner). Then aluminum liquid in a holding furnace enters a degassing device through a backflow tube for on-line purification, degassing, slag removal, and stress removal operations. Impurity removal and filtration are performed using a secondary filtering device. On a rotary belt casting machine, the aluminum liquid is cast and rolled into an aluminum coil billet by a continuous casting roller, then is guided from the casting machine to a hot rolling mill in which the thickness is reduced by 30% after hot rolling, and then enters a cold rolling mill, in which the thickness is reduced by 20% after cold rolling, through a roller rail. Finally, a 0.6 m wide aluminum plate is formed. The rolled aluminum plate is transmitted to a punching line, and an aluminum block is punched out using a 100-ton punching machine (oil (model MOBILSHCCIBUS68 lubricating oil, which is sprayed with 5 g/50 workpieces each time) is used in the punching process). Then annealing is performed in an annealing furnace (500° C.) for 2 h. A top space of the annealing furnace is continuously kept filled with the inert gas in the annealing process. After annealing, first aging treatment is performed at 400° C. for 2 h. A first aging product is cooled naturally and stored for 2 h, then passed through a densely-sprayed tunnel of aluminum alloy particles (3003 aluminum alloy particles with a hardness of 24-30 HB is used, and have a particle size of 0.3-1 mm, and the dense spray is performed at an air pressure of preferably 2 bar and a density of preferably 10 lattices/$mm^2$) with extremely high surface strength, then is subjected to second aging treatment at 80° C. for 2 h, and then put into a rotary surface treatment machine. Polyol (ethanol) and a fatty acid surface treatment agent (stearate) are added. The second aging product, the polyol, and the fatty acid surface treatment agent have a mass ratio of preferably 300:0.3:0.03. Surface rolling treatment is performed at 10 rpm for 10 min. Finally, a finished aluminum block is vibrated with a fine stainless steel sieve to remove impurities and fix the packing at the same time to obtain an aluminum material.

The aluminum punching process is formed, and on the basis of ordinary punching, a special punching die is added to produce a concave bowl-shaped aluminum block with a non-planar structure. In the present disclosure, the bowl-shaped aluminum block has an outer diameter of 34 mm, a depth of 0.5 mm, a diameter of an inner concave surface of 10 mm, and an angle of the inner concave surface to a horizontal plane of 1°. The bowl-shaped aluminum block obtained in this example has no oil stains, dust, pores, and slag inclusions, and there are no pull marks on the surface, no surface tearing, no sharp burrs and pits over 0.2 mm, and no obvious texture direction on the surface.

The present disclosure arranges the bowl-shaped aluminum block in a consistent concave surface, and arranges the bowl-shaped aluminum block in a consistent manner by a concave surface selector. The concave surface selector works at a selection speed of 200 pc/min.

In the present disclosure, the bowl-shaped aluminum block after arrangement is extruded into a barrel shape using an integrated extruder, and a can body is uniform and smooth at a processing deformation position, without wrinkles, scratches, and cracks. A minimum extrusion height is 130 mm. The bottom of the can has a thickness of 0.35 mm, and the wall of the can has a thickness of 0.2 mm.

The barrel-shaped aluminum can body is trimmed according to a designed can body length, and the mouth of the trimmed aluminum barrel has no wrinkles and notches.

First surface treatment: an outer surface of the barrel body is brushed and ground with reticulated stripes, and uneven protrusions and irregular stripes on the surface of the extruded aluminum material are removed, such that the surface becomes flat and smooth for printing and further forming.

Second surface treatment: mixed cleaning is performed with a cleaning solution including sodium salt, potassium salt, zirconium salt, and a surfactant (with a mass ratio of 3:3:2:2) at a temperature of 60° C. for 1 min. The can body becomes clean, which is convenient for further printing and processing. Then the barrel body enters an oven for drying at 100° C. for 10 min.

Coating of inner coating layer: unsaturated epoxy-polyester resin coatings are used for inner spraying. Each can body is sprayed 3 times by a spraying system. The coating film layer of the can wall is uniform from the bottom to the body.

Drying: coatings for the inner spraying are subjected to drying and curing in a drying oven at 200° C. for 10 min. A product after the inner coating layer is dried and cured is subjected to the coating film adhesion test, the result is level I, and the density test of the inner coating layer ≤5 mA.

Preparation of amino primer layer: the outside of the can wall is coated with amino primer, and the coatings have a viscosity of preferably 70 s (25° C.). The amino primer is dried at a temperature of 180° C. for 10 min.

Preparation of printing pigment layer: simultaneous printing is performed using a multi-color printer. The image is clear. The overprint accuracy is 0.02 mm. A high-precision imaging detection system is equipped to obtain the printing pigment layer without foreign matter adhesion. Then drying is performed at 180° C. for 10 min.

Glazing and drying: the printing pigment layer is coated with a layer of varnish to ensure that a necking deformation process will not damage the printing pigment layer, and enhance the visual gloss effect. The varnish has a viscosity of 70 s (25° C.). Then drying is performed at 180° C. for 10 min.

Preparation of surface paint protection layer and wear-resistant layer: the varnish is coated with surface paint protection coatings. The surface paint protection coatings include an improved polyester material and PTFE. The PTFE in the surface paint protection coatings has a mass content of 0.2%. After the coating is completed, high-temperature curing is performed at 200° C. for 10 min, and aging treatment is performed at 50° C. for 1 h to form the wear-resistant layer on a surface of the PTFE layer. The PTFE precipitates at the high-temperature curing stage to form the surface paint protection layer, so as to form the wear-resistant layer.

Necking: the barrel-shaped can body undergoes a 40-station necking process. The necking uses a rolling and pressing integrated construction process, and the necking amount of each process is controlled to 5 mm according to different forming angles. A formed can with a necking and rolling mouth shape is preferably formed on the can body. The necked can body is uniform and smooth at the processing deformation position, without wrinkles, scratches, cracks, and pits. The weight deviation of each batch of cans is ±2 g. A bottle mouth has an outer diameter after necking forming of 26.6±0.2 mm, and the bottle mouth has an inner diameter of 20.5±0.1 mm. The crimping has a height of 3.85±0.2 mm. The can height deviation is controlled to H ±0.5 mm.

Leak detection: a finished can is automatically detected after air pressure filling, so that micropores with a size of 0.1 mm is found in a strong light detector.

Drying: the aluminum can is washed with pure water in a post-washing machine, and dried at 100° C. for 10 min in a 100,000-level purification workshop.

Packaging: after the inner packaging is completed, the entire tray is transferred to the outside of a clean room for replacement of the outer tray packaging. A wrapping film is used to package and fix the outside of the entire aluminum can tray, and a mark is made.

Finished product inspection: strict item-by-item inspection is performed according to product standard requirements: adhesion detection of a finished paint film, hardness detection of an outer coating layer, density detection of the inner coating layer, pressure resistance detection, chemical stability testing of the inner and outer coating layers, and microbiological detection, so as to obtain the aluminum bottle. The aluminum bottle is of the same specifications as a commercially available 12 floz aluminum bottle.

Figure 1:
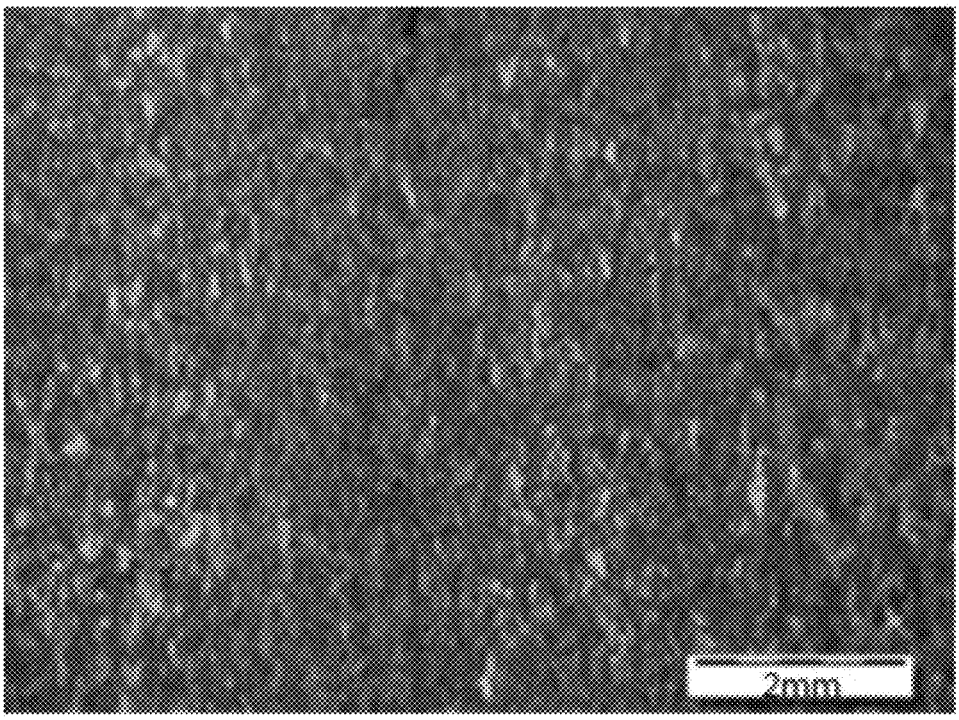
FIG. 1 is a microtopography diagram of an aluminum plate base layer prepared in Example 1.

FIG. 1 is a microtopography diagram of the aluminum plate base layer prepared in Example 1. It can be seen from FIG. 1 that the internal structure of the aluminum plate base layer is uniform and the crystal grains are refined.

Example 2

This example is the same as Example 1, except that the aluminum plate base layer of this example includes the following elements by mass percentage: 0.1% of Si, 0.3% of Fe, 0.05% of Cu, 0.03% of Mn, 0.03% of Mg, 0.05% of Zn, 0.05% of Ti, 0.03% of Ni, 0.05% of Sr, 0.05% of Zr, 0.05% of B, and the balance of Al.

Example 3

This example is the same as Example 1, except that a D66 mm aluminum can is prepared.

Comparative Example 1 is a commercially available 12 fl oz 1070 aluminum bottle.

The 1070A aluminum bottle includes the following elements by mass percentage: 0.2% of Si, 0.25% of Fe, 0.03% of Cu, 0.03% of Mn, 0.03% of Mg, 0.07% of Zn, 0.03% of Ti, and the balance of Al.

Comparative Example 2 is a commercially available D66 mm aluminum bottle.

The performance of the aluminum bottles of Examples 1 to 2 and Comparative Example 1 is measured. The results are as follows: the aluminum bottles of Examples 1 to 2 and the comparative example have a weight of 32 g, 35 g, and 45 g respectively, and the aluminum bottles of Examples 1 to 2 and Comparative Example 1 have a bearing strength of 5.6 KN, 4.8 KN, and 4 KN respectively. The empty can has internal pressure resistance of 1.7 Mpa, 1.3 Mpa, and 0.9 Mpa respectively.

The performance of the aluminum bottles of Example 3 and Comparative Example 2 is compared. The results are shown in Table 1. It can be seen from Table 1 that the aluminum bottle prepared by the present disclosure is light in weight and have excellent pressure and burst resistance.

TABLE 1

Performance data of aluminum bottles of Example 3 and Comparative Example 2

| | Comparative Example 2 | Example 3 |
|---|---|---|
| Specification | D66 × 150 | D66 × 150 |
| Can weight | 62 g | 55 g |
| Pressure resistance | 1.9 Mpa | 1.93 Mpa |
| Burst resistance | 2.15 Mpa | 2.21 Mpa |

The above described are merely preferred implementations of the present disclosure rather than limitations to the present disclosure in any form. It should be noted that those of ordinary skill in the art may further make several improvements and modifications without departing from the principle of the present disclosure, but such improvements and modifications should be deemed as falling within the protection scope of the present disclosure.

What is claimed is:

1. A method of preparing an aluminum bottle comprising the following steps:

under a condition that the aluminum bottle comprises an inner coating layer, an aluminum plate base layer, a surface passivation layer, an amino primer layer, a printing pigment layer, a surface paint protection layer, and a wear-resistant layer sequentially stacked, the aluminum plate base layer comprises the following elements by mass percentage: 0.1-0.2% of Si, 0.25-0.35% of Fe, 0-0.05% of Cu, 0.03-0.5% of Mn, 0-0.03% of Mg, 0-0.05% of Zn, 0-0.05% of Ti, 0-0.03% of Ni, 0-0.05% of Sr, 0-0.05% of Zr, 0-0.05% of B, and the balance of Al, the Al has a mass percentage ≥99.2%, performing batching according to the elements of the aluminum plate base layer, and then smelting to obtain molten aluminum;

performing primary slagging, refinement, secondary slagging, refined degassing, and casting rolling sequentially on the molten aluminum to obtain an aluminum coil billet;

performing primary hot casting rolling, cooling, cold rolling, and punching sequentially on the aluminum coil billet to obtain an aluminum block billet;

performing annealing and first aging treatment sequentially on the aluminum block billet to obtain a first aging product;

performing surface treatment and second aging treatment on the first aging product to obtain an aluminum material;

stamping and forming the aluminum material to obtain a bowl-shaped aluminum block;

performing arrangement, extrusion, and surface treatment sequentially on the bowl-shaped aluminum block to obtain a can body forming the surface passivation layer;

spraying on an inner surface of the can body forming the surface passivation layer to form the inner coating layer;

forming the amino primer layer, the printing pigment layer, the surface paint protection layer, and the wear-resistant layer sequentially on an outer surface of the can body forming the surface passivation layer to obtain a treated can body; and necking the treated can body to obtain the aluminum bottle, wherein the surface passivation layer is prepared by cleaning with a cleaning solution, and the cleaning solution comprises sodium salt, potassium salt, zirconium salt, and a surfactant.

2. The method of preparing an aluminum bottle according to claim 1, wherein a process of forming the amino primer layer comprises the following steps: coating amino coatings, and then drying at 100-200° ° C. for 5-15 min.

3. The method of preparing an aluminum bottle according to claim 1, wherein a process of forming the surface paint protection layer comprises the following steps: coating surface paint protection coatings comprising an improved polyester material and polytetrafluoroethylene (PTFE), and then drying at 100-200° C. for 5-15 min.

4. The method of preparing an aluminum bottle according to claim 3, wherein the PTFE in the surface paint protection coatings has a mass content of 0.2-0.4%.

5. The method of preparing an aluminum bottle according to claim 3, wherein a process of forming the wear-resistant layer comprises the following steps: performing heating curing and aging treatment sequentially on the surface paint protection layer to form the wear-resistant layer on a surface of the surface paint protection layer.

6. The method of preparing an aluminum bottle according to claim 4, wherein a process of forming the wear-resistant layer comprises the following steps: performing heating curing and aging treatment sequentially on the surface paint protection layer to form the wear-resistant layer on a surface of the surface paint protection layer.

7. The method of preparing an aluminum bottle according to claim 1, wherein the necking is performed for 40 times at a necking amount of 1-5 mm in each step.

* * * * *